US007370598B1

(12) United States Patent
Bootes

(10) Patent No.: US 7,370,598 B1
(45) Date of Patent: May 13, 2008

(54) POWER DRIVEN MARINE LADDER

(75) Inventor: Todd Bootes, Fort Myers, FL (US)

(73) Assignee: PWC Industries, Inc., Fort Myers, FL (US)

( * ) Notice: Subject to any disclaimer, the term of this patent is extended or adjusted under 35 U.S.C. 154(b) by 0 days.

(21) Appl. No.: 11/350,588

(22) Filed: Feb. 9, 2006

(51) Int. Cl.
*B63B 17/00* (2006.01)
*B63C 9/00* (2006.01)
*E06C 1/00* (2006.01)

(52) U.S. Cl. ..... 114/362; 441/80; 182/194

(58) Field of Classification Search ..... 114/362, 114/382; 441/80, 136
See application file for complete search history.

(56) References Cited

U.S. PATENT DOCUMENTS 2,840,289 A * 6/1958 Murray ..... 182/77
6,328,129 B1 * 12/2001 Ferguson ..... 182/70

* cited by examiner

*Primary Examiner*—Jesus Sotelo
*Assistant Examiner*—Daniel V Venne
(74) *Attorney, Agent, or Firm*—William E. Noonan

(57) ABSTRACT

A power driven marine ladder apparatus includes a vertically extendable cable section and a horizontally extendable rung section connected transversely to the cable section. An axially rotatable winder is mounted on a marine vessel or fixed marine structure and the cable section is attached to and wrappable about the winder. A motor drives the winder rotatably in a first direction to unwrap the cable section and lower the ladder apparatus, and in an opposite second direction to wrap the cable section on the winder and raise the ladder apparatus.

17 Claims, 5 Drawing Sheets

POWER DRIVEN MARINE LADDER

FIELD OF THE INVENTION

This invention relates to a marine ladder for use on a boat, jet ski, dock, seawall or other marine environment. More particularly, the invention relates to a marine ladder that is selectively deployed and retracted by a motor.

BACKGROUND OF THE INVENTION

Many marine vessels are equipped with a ladder that enables a swimmer, a diver or other individual to climb out of and into the water. Conventional boat ladders tend to be rather bulky and are often quite unwieldy to set up. Such ladders tend to take up a lot of space and are not convenient to remove and store between uses. In addition, ascending and descending the typical boat ladder can be tedious and awkward. A person weighted down by diving equipment can find using the ladder to be particularly arduous and troublesome. Rungs can break and hazardous falls can occur.

SUMMARY OF THE INVENTION

It is therefore an object of the present invention to provide a power driven marine ladder that greatly facilitates the process of climbing into and out of a boat.

It is a further object of this invention to provide a power driven boat ladder that automatically raises and lowers a swimmer, diver or other person such that the difficulty and danger associated with climbing into and out of a boat are reduced considerably.

It is a further object of this invention to provide a boat ladder that is conveniently compactable and which may be readily retracted and stored when not in use so that it does not interfere with use of the vessel.

It is a further object of this invention to provide a power driven boat ladder that may be used on virtually all types of marine vessels including boats and personal watercraft.

It is a further object of this invention to provide a power driven boat ladder that is convenient to install and utilize on both new and existing marine vessels.

It is a further object of this invention to provide a boat ladder that affords much improved and more convenient access to the deck or swim/dive platform of a marine vessel and which is especially suited for use by swimmers, divers and similarly situated individuals.

It is a further object of this invention to provide a marine ladder that is much easier and safer to use than conventional marine ladders.

It is a further object of this invention to provide a marine ladder that may be utilized effectively on docks, piers, seawalls and other fixed marine structures.

This invention results from a realization that climbing into a vessel from an underlying body of water and alternatively descending into the water from the vessel are facilitated considerably by utilizing a power driven marine ladder. Such a ladder is quick and convenient to either deploy or remove as required. In addition, raising the marine ladder by the operation of a motor, enables a swimmer, a diver or other person in the water to be pulled or raised effortlessly into the boat without that person having to struggle climbing up the ladder. The boarding operation is thereby facilitated considerably.

This invention features a power driven marine ladder apparatus for use on a marine vessel afloat on a body of water. The vessel may comprise virtually any type of watercraft including boats and personal watercrafts. The apparatus includes a retractable ladder having a vertically extendable cable section and a horizontally extendable rung section connected transversely to the cable section. An axially rotatable winder mechanism is mounted on the marine vessel. The cable section is attached to and wrappable about the winder mechanism. A motor drives the winder rotatably in a first direction to unwrap the cable from the winder and lower the ladder toward the body of water. Alternatively, the motor is operated in an opposite, second direction to wrap the cable section about the winder and raise the ladder from the body of water.

In a preferred embodiment, the cable section includes a pair of generally parallel cables attached at respective upper ends of the winder. The rung section preferably includes a single rung interconnected between the parallel cables proximate respective lower distal ends thereof.

A guide assembly may be mounted to the vessel. The guide assembly directs movement of the cable section between the winder and the body of water in response to operation of the motor. The guide assembly may include a pair of generally parallel channels mounted to the vessel. Each channel accommodates a respective cable between the winder and a side of the vessel. A directional pulley may be axially rotatably mounted in each channel proximate a distal end thereof for redirecting the accommodated cable vertically from the channel and the side of the vessel to the body of water beneath the vessel.

The winder may include a drive shaft axially rotatably mounted to the vessel and carrying a cable supporting pulley. This pulley holds a respective cable thereon. A reduction mechanism may operably interconnect the winder and the motor for controlling the speed at which the winder rotates in the first and second directions. A manually actuatable switch may be mounted to the vessel proximate the side thereof for selectively activating and deactivating the motor to raise and lower the ladder.

The marine ladder of this invention is also employed effectively on various fixed marine structures such as docks, piers and seawalls. The features and benefits are analogous to those exhibited by the vessel mounted ladder.

DETAILED DESCRIPTION OF PREFERRED EMBODIMENTS

Other objects, features and advantages will occur from the following description of a preferred embodiment and the accompanying drawings, in which.

Figure 1:
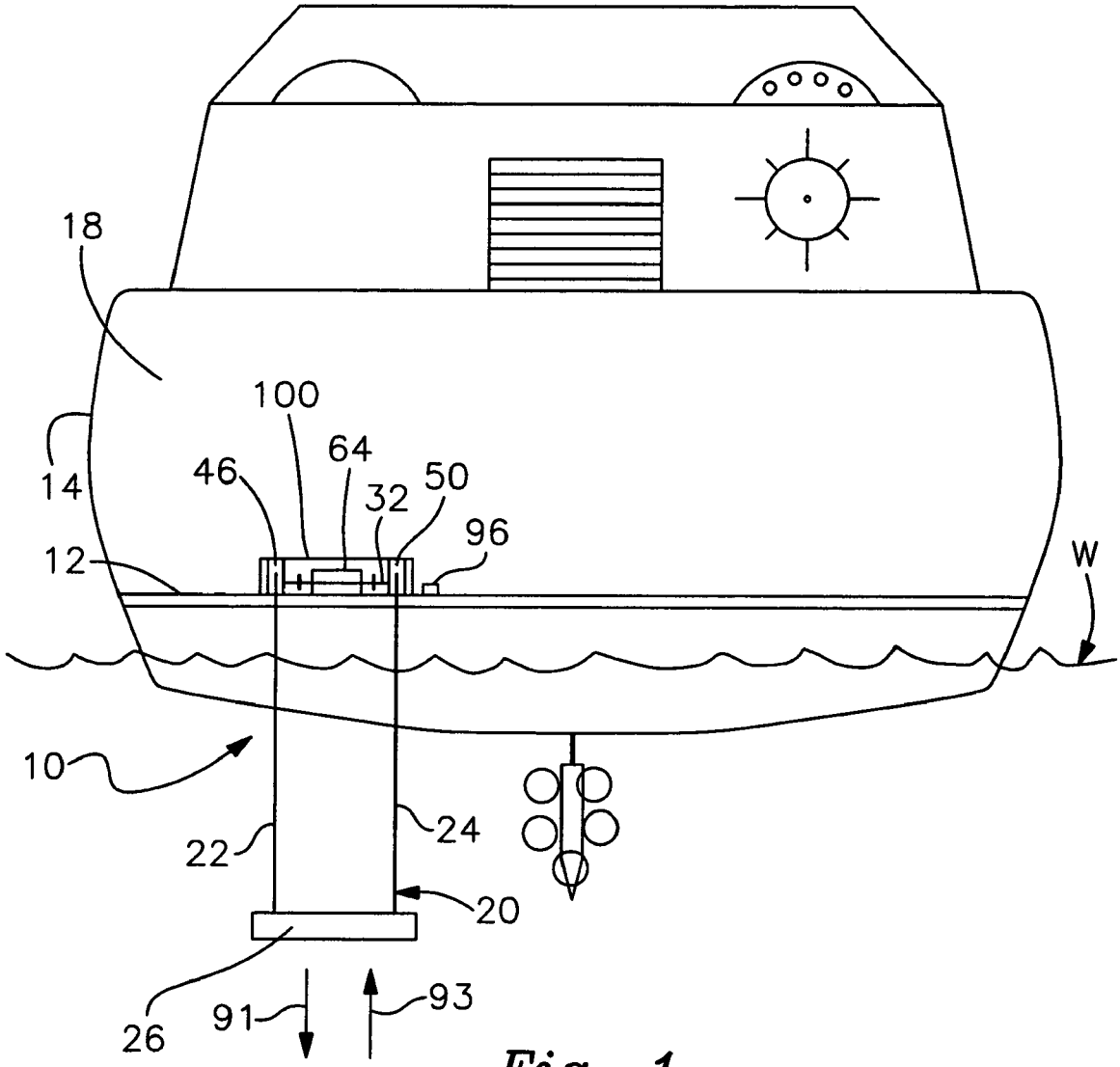
FIG. 1 is an elevational view of the stern of a marine vessel equipped with the power driven marine ladder of this invention.

There is shown in FIG. 1, a power driven marine ladder apparatus 10 mounted to the swim platform 12 of a boat 14. The boat may comprise virtually any type of marine vessel designed to float upon and operate in a body of water W. The particular type of vessel with which apparatus is used does not comprise a limitation of this invention. Although the embodiment of FIG. 1 is depicted as mounted to a swim or dive platform, in alternative versions, the power driven marine ladder apparatus may be secured to various other components such as the hull, deck, etc. of the vessel. In the version depicted in FIGS. 1-3, apparatus 10 is mounted to a swim platform 12 that is attached in a conventional manner to the transom 18 of boat 14.

Figure 2:
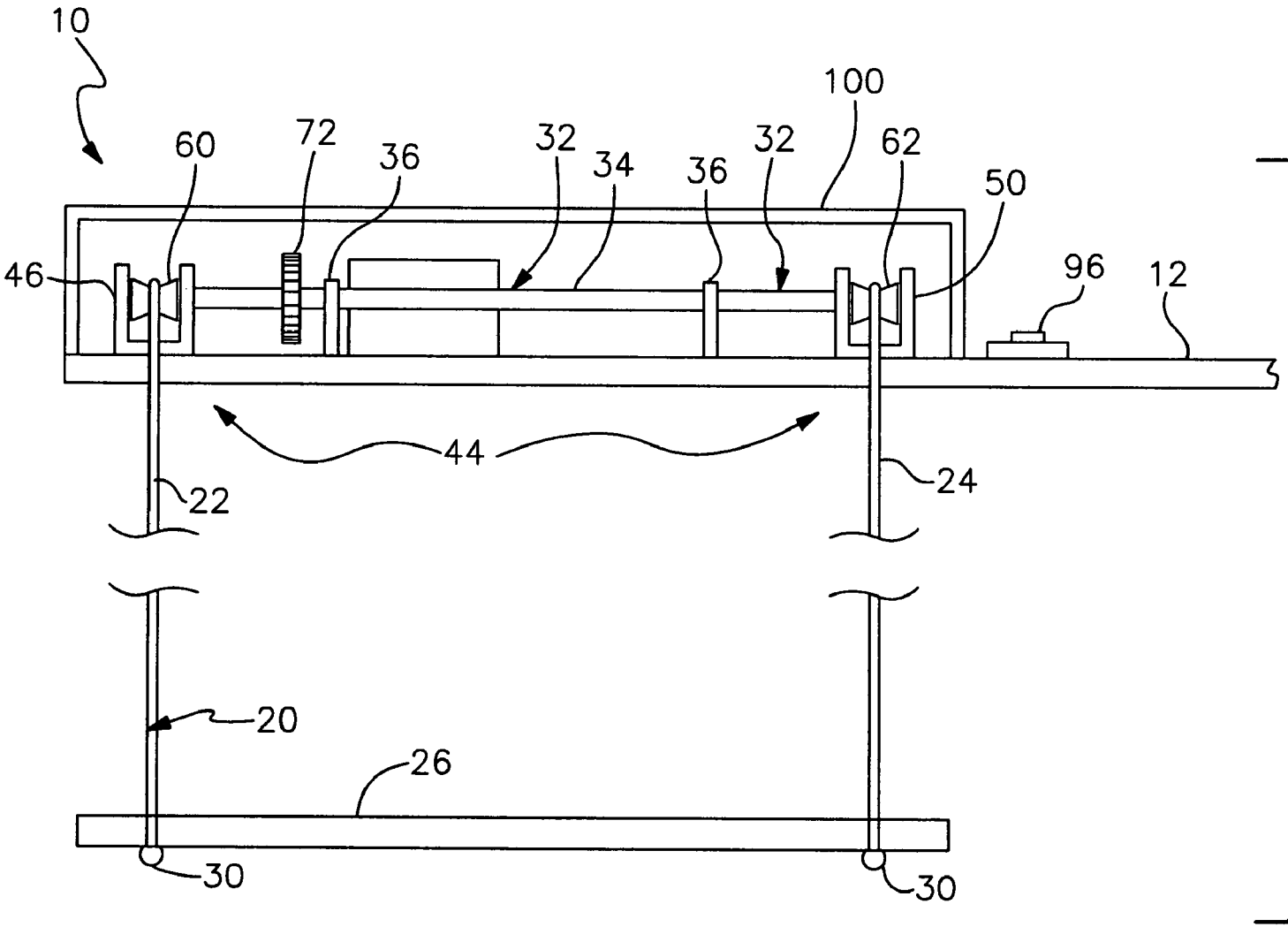
FIG. 2 is an elevational stern view of the power driven marine ladder apparatus mounted on the swim platform of a boat.
Figure 3:
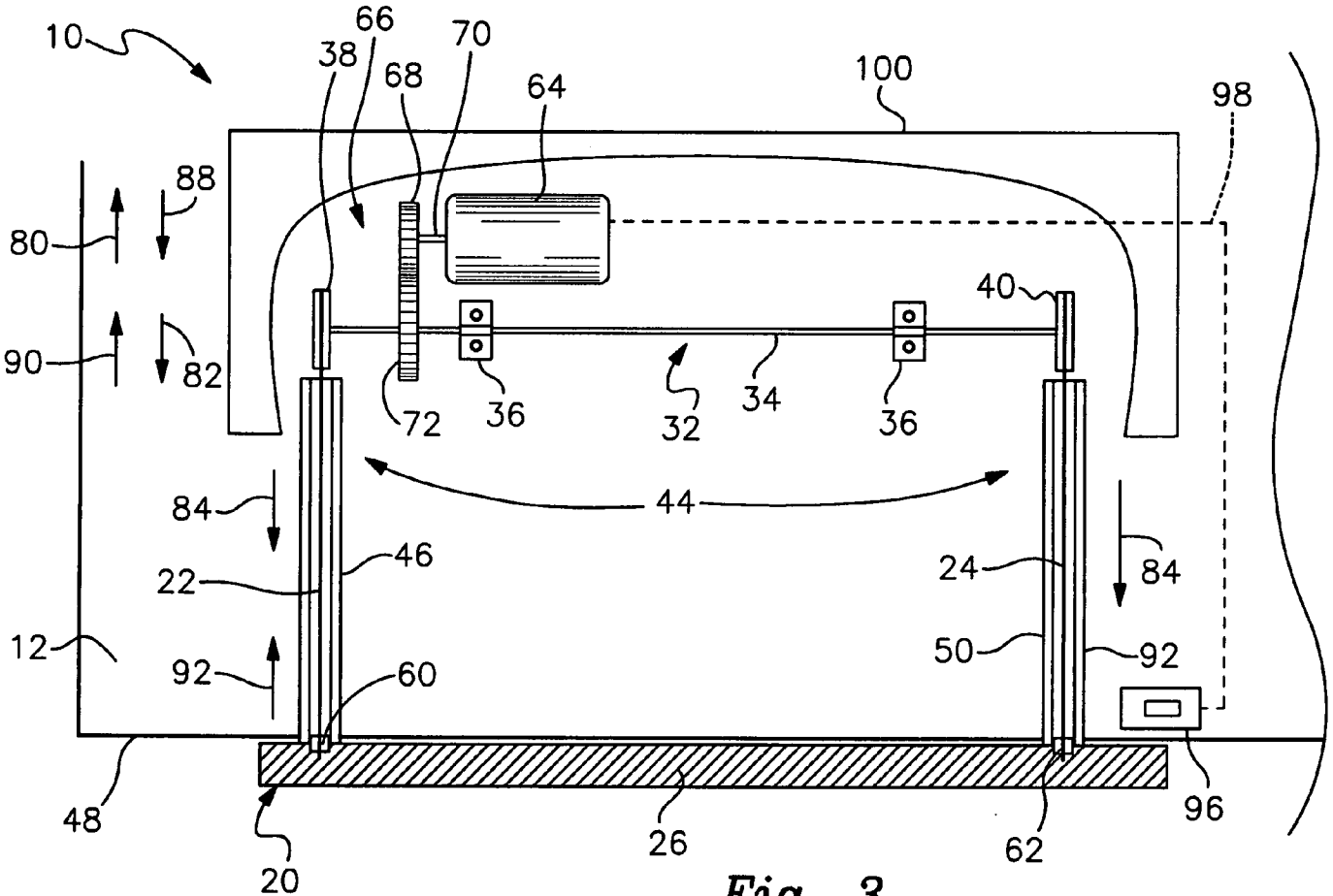
FIG. 3 is a top plan view of the ladder apparatus as it is mounted on the swim platform.

As depicted in FIGS. 1-3, ladder apparatus 10 includes a retractable ladder 20 comprising a pair of flexible and generally parallel cables 22, 24 that are interconnected by a transverse rung 26. With the ladder 20 deployed from vessel 14, as best illustrated in FIG. 1, the cables depend vertically from swim platform 12 and rung 26 extends more or less horizontally between the parallel cables. As used herein, "cables" should be understood to denote virtually any type of elongate, flexible element including, but not limited to rope, wires, multi or monofilament strands and synthetic materials. Rung 26 is preferably composed of a relatively rigid material designed to securely support the weight of a person standing on the rung. Typically, a single rung only is utilized and that rung is attached proximate the lower distal ends of cables 22 and 24. As shown in FIG. 2, the distal ends of the cables may include knots 30 or other mechanical means for attaching the cables to the rung. In alternative versions of the invention, multiple rungs may be secured at spaced apart intervals along cables 22 and 24.

The opposite upper ends of the ladder cables are attached to and wrappable about a winder mechanism 32. The winder mechanism includes an elongate drive shaft 34 that is axially rotatably mounted upon the upper surface of swim platform 12 by means such as bearings 36. A pair of cable collection pulleys 38 and 40, best shown in FIG. 3, are mounted proximate respective ends of shaft 34. Each of the pulleys 38 and 40 is axially mounted to shaft 34 such that the collection pulleys axially rotate with the drive shaft. As best shown in FIG. 3, an upper end of each cable 22, 24 is secured to and windable about a respective one of the pulleys 38 and 40. The cables are fastened to their respective pulleys or other winder components in a conventional manner.

A guide assembly 44, FIGS. 2 and 3, is employed to direct cables 22 and 24 from their respective collection pulleys 38 and 40 to the vertically depending condition best shown in FIGS. 1 and 2. Specifically, guide 44 includes a first extruded U-channel 46 that extends between collection pulley 38 and a side edge 48 of swim platform 12. Guide 44 also includes a second extruded U-channel 50 that analogously extends between collection pulley 40 and side edge 48 of platform 12. The channels may have various other configurations and may be composed of a variety of materials. Each of the channels 46 and 50 is mounted to the upper deck of swim platform 12 by bolts or similar means of attachment.

Each of the cables 22 and 24 extends horizontally through its respective channel 46, 50. At the side edge 48 of platform 12, the cables are directed vertically downward by respective directional pulleys. In particular, a directional pulley 60, FIGS. 2 and 3, is mounted to axially rotate within channel 46 proximate the outer end of that channel. A second directional pulley 62 is likewise mounted for axial rotation proximate the outer end of channel 50. Pulleys 60 and 62 extend slightly beyond the outer ends of their respective channels. Each pulley is engaged by a respective cable 22, 24 and the directional pulleys direct those cables downwardly from platform 12 as best illustrated in FIG. 2. Rung 26 then interconnects the lower ends of the cables as previously described. The directional pulleys 60 and 62, as well as the collection pulleys 38 and 40 may be composed of various durable materials and may have various pulley configurations in accordance with this invention. The collection pulleys should include a groove that is sufficiently deep to wrap a respective one of the cables 38, 40 thereon as the winder 32 is wound in a direction that retracts and raises the cables and therefore the ladder 20.

Winder mechanism 32 is driven selectively in opposing first and second directions to respectively lower and raise marine ladder 20. More particularly, the winder is driven by a DC motor 64, FIGS. 1-3, that is interconnected to winder 32 by a reduction mechanism 66. The reduction mechanism may include various means such as gears, pulleys, belts and chains for driving shaft 34 of winder mechanism 32 at a selected speed. In the version depicted in FIGS. 1-3, reduction mechanism 66 comprises a first gear 68 that is axially rotated by a shaft 70 connected to motor 64. Gear 68 directly interengages a driven gear 72 axially and fixedly mounted on shaft 34. As the motor drives gear 68, the circumferential teeth of that gear mesh with the teeth of driven gear 72. As a result, gear 68 turns gear 72, which in turn rotates shaft 34. When the shaft rotates, the attached collection pulleys 38 and 40 similarly rotate to drive cables 22 and 24 in a selected direction. Various types of DC motors may be employed. A one-half horsepower motor is particularly preferred. The motor should be capable of operating in two opposing directions. When it is driven in a first direction indicated by arrow 80 in FIG. 3, driving gear 68 turns driven gear 72 in the direction of arrow 82. Pulleys 38 and 40 rotate in a like direction. This causes cables 22 and 24 to be driven horizontally through their respective channels 46 and 50 as indicated by arrows 84. At the distal end of each channel, the directional pulleys 60 and 62 direct the cables vertically downwardly and thereby ladder 20 is lowered as indicated by arrow 91 in FIG. 1.

When motor 64 is driven in the opposite second direction, indicated by arrow 88, FIG. 3, driven gear 72 is turned in the direction of arrow 90. This rotates shaft 34 and pulleys 38 and 40 in a similar direction. Cables 22 and 24 are thereby retracted within their respective channels as indicated by arrows 92. The cables are pulled upwardly and over their respective directional pulleys 60 and 62 and the ladder is raised as indicated by arrow 93 in FIG. 1.

Motor 64 is selectively activated and deactivated by a manually operated switch 96 that is mounted on platform 12 adjacent to one of the guide channels 50. Switch 96 is electrically interconnected to motor 64 by appropriate wiring 98. The switch is actuated as needed to start and stop motor 64 and to select the direction of travel for the motor and therefore the ladder. The switching operation is analogous to the operation of a garage door opener. Operably connecting the switch to the motor is performed using techniques that will be known to persons skilled in the art. The switch may be located at various points proximate to the power driven ladder apparatus. Various alternative switching arrangements may be employed. The motor may be operated by remote control switch and/or radio frequency transmitter.

A housing or enclosure 100 at least partially covers the motor, winder and guide assembly of apparatus 10. Enclosure 100 may be composed of Lucite™ or other durable and weather-resistant materials capable of withstanding a harsh marine environment. Preferably, the enclosure should be transparent so that the operation of the motor and winder are clearly visible. Mechanical and/or operating problems can be observed and addressed promptly as needed.

When apparatus 10 is not in use, ladder 20 is retracted onto the deck or platform 12. Cables 22 and 24 are wound about respective pulleys 38 and 40. Rung 26 is supported above or proximate to the upper deck of platform 12.

Ladder apparatus 10 is deployed as needed, for example, to retrieve a swimmer or diver from water W. To accomplish this, switch 96 is pressed or otherwise actuated so that motor 64 turns in the direction of arrow 80. Winder 32 is driven by reduction mechanism 66 in an opposite direction. This allows rung 26 to drop or be pulled downwardly from the side edge 48 of the vessel. Cables 22 and 24 play out from their respective collection pulleys and travel horizontally through their respective channels 46 and 50 from the rearward end to the distal end of the channels. Eventually, rung 26 is lowered to the position shown in FIG. 1. The swimmer, diver or other individual in the water W grasps, climbs onto and stands upon rung 26 while holding onto cables 22 and 24. The person standing on rung 26 or alternatively another person located on platform 12, actuates switch 26 again so that winder 32 rotates in the opposite direction of arrow 90. This retracts ladder 20 upwardly as indicated by arrow 93 in FIG. 1. Cables 22 and 24 are pulled longitudinally through channels 46 and 50 as indicated by arrow 92 in FIG. 3A. Each cable is wound upon its respective collection pulley 38, 40. Eventually, the ladder is raised sufficiently so that the person standing on the rung is able to easily climb onto the platform. The raised ladder can then remain in the stored position it is subsequently needed.

It should be understood that a person can return to the water from the vessel by operating the ladder in an opposite direction. Specifically, the switch 96 is actuated to lower the ladder as sufficient amount so that a person desiring to descend into the water is able to stand upon rung 26. After that person is comfortably and safely positioned on the rung, switch 96 is reactivated (once or multiple times as needed) so that the motor 64 lowers ladder 20 fully into the water. At any point in the process, the operation of the motor and therefore the operation of the power driven ladder may be stopped by simply actuating the switch 96 to send a "stop" signal to the motor. Subsequent reactivation of the switch causes the raising/lowering operation to continue as needed. Operation of the switch and connected motor raises/lowers/stops or reverses movement of the ladder as appropriate. Once again, the switch and motor operate analogously to the components used in a standard garage door opener. It is also possible to utilize a motor that operates in only a single direction and for the ladder to be released for travel in the opposite direction. In the latter case such that the motor and winder freewheel and allow the ladder to be pulled into or out of the water as applicable.

Figure 4:
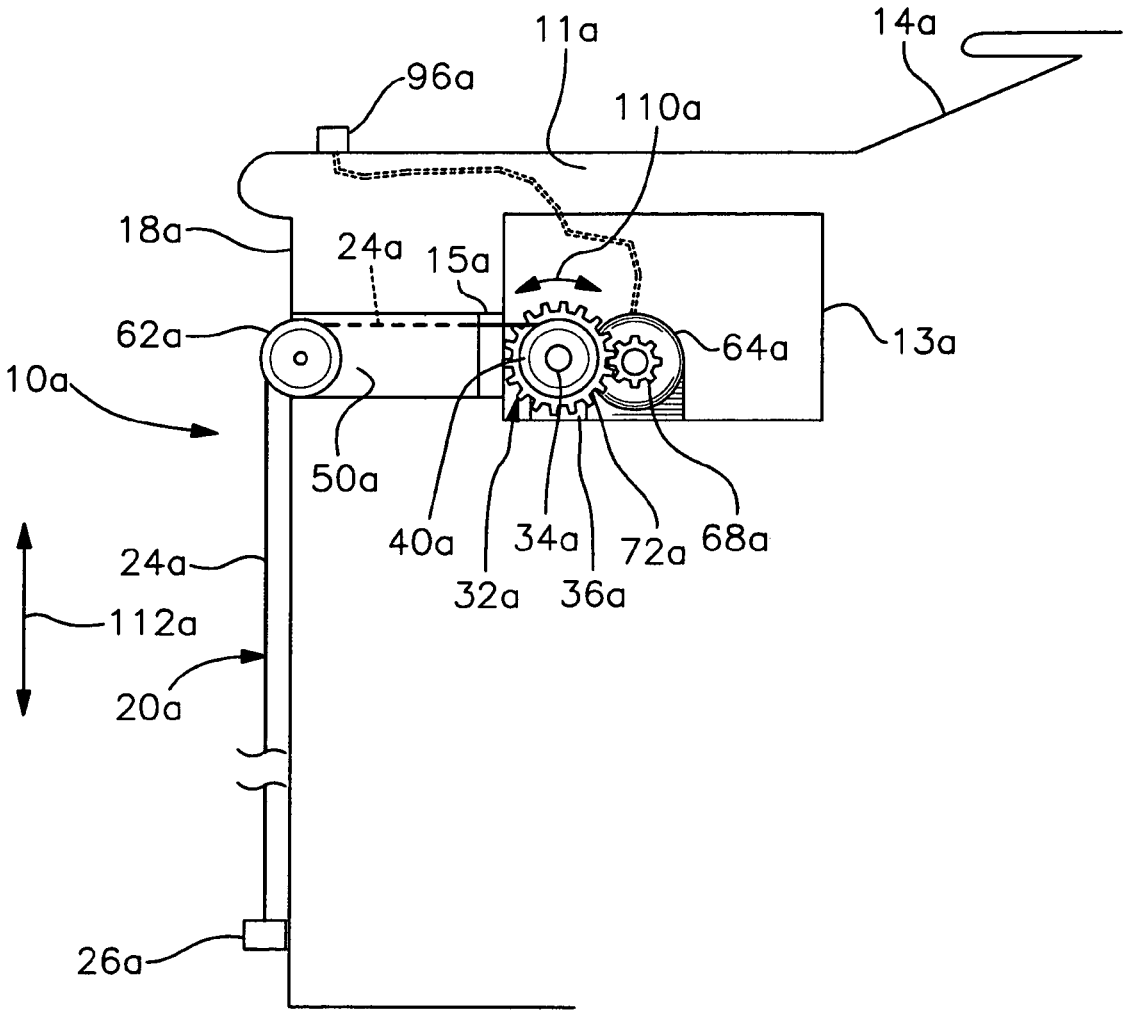
FIG. 4 is a side, cross sectional view of an alternative version of the power driven marine ladder apparatus as mounted within the hull of a personal watercraft.
Figure 5:
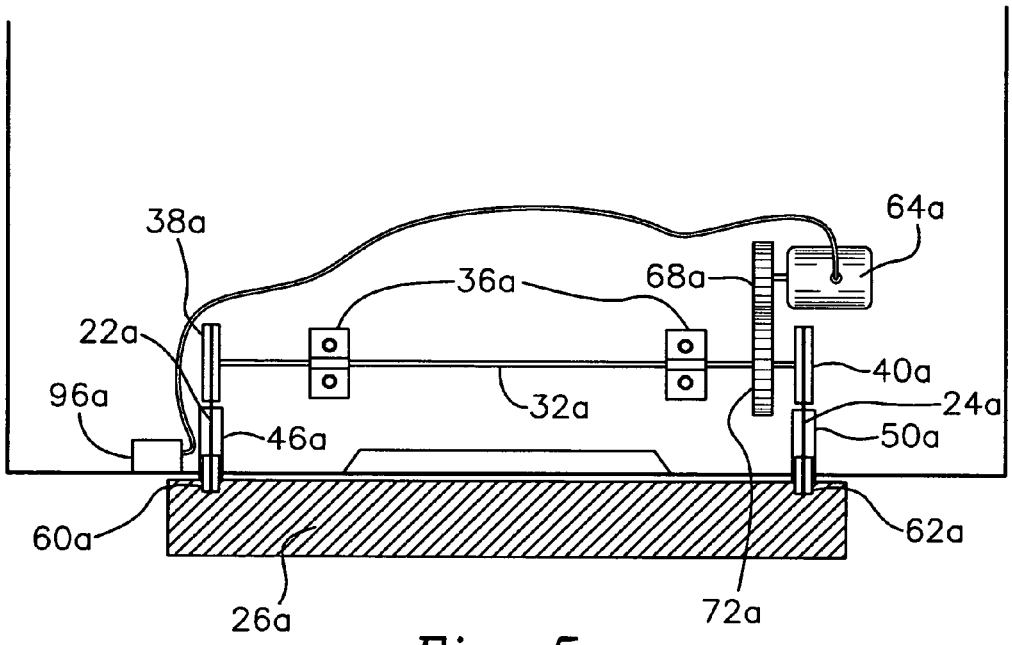
FIG. 5 is a top plan view of the version of the ladder shown in FIG. 5.

In the alternative version shown in FIGS. 4 and 5, power driven ladder apparatus 10*a* is mounted within the hull 11*a* of a personal watercraft 14*a*. A cavity 13*a* formed in the hull is communicably connected to a passageway 15*a* that extends from cavity 13*a* to an opening in the transom 18*a* of watercraft 14*a*. A DC motor 64*a* is mounted within cavity 13*a*. Motor 64*a* axially rotatably operates a drive gear 68*a*. This gear, in turn, operably interengages a driven gear 72*a* that is axially mounted on a drive shaft 34*a* of a winder 32*a*. A pair of collection pulleys 38*a* are mounted at spaced apart positions on shaft 34*a* in a manner analogous to the prior embodiment. Indeed, the drive shaft 34*a* and collection pulleys 38*a* (only one of which is shown) comprise a winder. Shaft 34*a* is axially rotatably mounted within the cavity by a pair of bearings 36*a*, which may comprise U-bolts mounted within the cavity and accommodating respective bearings that permit axial rotation of shaft 34*a*. The interengaged gears 72*a* and 68*a* comprise a reduction mechanism. The motor, reduction mechanism and winder are all constructed analogously to the components of the previously described embodiment. All are mounted in cavity 13*a* of hull 11*a*.

A retractable ladder 20*a* is again operably connected to winder 32*a*. Once again, the ladder includes a pair of elongate, flexible cables 22*a*, 24*a*. Cable 22*a* is attached at its upper end to the circumference of pulley 30*a*. Cable 24*a* is likewise attached to its upper end to pulley 40*a*. Cable 22*a* extends through an extruded U-channel 46*a*, which is fitted within passageway 15*a* of the boat hull. Likewise, cable 24*a* extends horizontally through a second extruded U-channel 50*a* that extend through passageway 15*a*.

Directional pulleys are again employed in this version for redirecting the cables between horizontal and vertical orientations. In particular, a first directional pulley 60*a*, FIG. 5 is axially rotatably mounted proximate the outer end of channel 46*a*. Cable 22*a* engages pulley 60*a* and is directed vertically by that pulley downwardly to rung 26*a*. The lower end of cable 22*a* is connected to rung 26*a* in the manner previously described.

By the same token, second directional pulley 62*a*, FIGS. 4 and 5, is axially rotatably mounted proximate the distal end of channel 50*a*. Cable 24*a* extends horizontally through channel 50*a* and engages pulley 62*a*, which redirects cable 24*a* vertically. Cable 24*a* is attached at its lower end to rung 26*a*, which extends transversely between the cables as shown in FIG. 5.

Power driven ladder apparatus 10*a* operates in a manner analogous to that previously described for the versions of FIGS. 1-3. In particular, a switch 96*a* is engaged to start, stop and reverse direction of motor 64*a*. Once again, the motor is operated in a manner analogous to the motor operating a garage door opener. As a result, the winder is driven forwardly and rearwardly, as needed, in the manner indicated by doubleheaded arrow 110*a* in FIG. 4. This selectively retracts the cables to raise the ladder and extends the cables to lower the ladder, as indicated by doubleheaded arrow 112*a*. A swimmer, diver or other person standing on the ladder is thereby retrieved from or lowered into the water as needed. This is accomplished quickly and conveniently without the person having to struggle climbing or descending a series of steps. Between uses, the ladder is conveniently retracted and stored.

In alternative embodiments, the marine ladder of this invention may be mounted to an assortment of fixed or floating marine structures not associated with a vessel. These include, but are not limited to docks, seawalls, piers, swim platforms, oil rig platforms, etc. The structure, function and beneficial results described above apply as well in such applications.

From the foregoing it may be seen that the apparatus of this invention provides for a marine ladder for use on a boat, jet ski, dock, seawall or other marine environment. More particularly, the invention relates to a marine ladder that is selectively deployed and retracted by a motor. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A power driven marine ladder apparatus for use on a marine structure afloat on or otherwise adjacent to a body of water, said apparatus comprising:

a retractable ladder including a vertically extendable cable section and horizontally extendable rung section connected transversely to said cable section;

an axially rotatable winder for mounting on the structure; said cable section being attached to and wrappable about said winder;

a motor for driving said winder in a first direction to unwrap said cable section from said winder and lower said ladder toward the body of water, and in an opposite, second direction to wrap said cable section about said winder and raise said ladder from the body of water; and a guide assembly for mounting to the marine structure and directing movement of said cable section between said winder and the body of water in response to operation of said motor, said cable section including an elongate flexible cable and said guide assembly including a horizontal channel for accommodating said cable section between said winder and a side of the marine structure.

2. The apparatus of claim 1 in which said cable section includes a pair of generally parallel cables attached at respective upper ends to said winder.

3. The apparatus of claim 2 in which said rung section includes a single rung interconnected between said cables proximate respective lower distal ends thereof.

4. The apparatus of claim 1 in which said guide further includes a directional pulley axially rotatably mounted in said channel proximate a distal end thereof for redirecting said accommodated cable vertically from the structure to the body of water.

5. The apparatus of claim 1 in which said cable section includes an elongate flexible cable and said winder includes a drive shaft axially rotatably mounted to the marine vessel and carrying a cable supporting pulley, which pulley windably holds said cable thereon.

6. The apparatus of claim 1 further including a reduction mechanism for operably interconnecting said winder and said motor for controlling the speed at which said winder rotates in said first and second directions.

7. The apparatus of claim 1 further including a manually actuatable switch mounted to the vessel proximate the side thereof for selectively activating and deactivating said motor to raise and lower said ladder.

8. A power driven marine ladder apparatus for use on a marine structure afloat on or otherwise adjacent to a body of water, said apparatus comprising:

a pair of generally parallel and vertically extendable cables and at least one horizontally extendable rung connected transversely between said cables;

an axially rotatable winder mechanism for mounting on the structure, said cables being attached to and wrappable about said winder;

a motor for driving said winder rotatably in a first direction to unwrap said cables from said winder and lower said ladder toward the body of water, and in an opposite, second direction to wrap said cables about said winder and raise said ladder from the body of water; and a guide assembly for mounting to the marine structure and directing movement of said cables between said marine structure and the body of water in response to operation of said motor; said guide assembly including a pair of generally parallel, horizontal channels, each channel for accommodating a respective one of said cables between said winder and a side of the marine structure.

9. The apparatus of claim 8 in which said guide assembly includes a pair of directional pulleys, each directional pulley being axially rotatably mounted in a respective one of said channels proximate a distal end thereof for redirecting the cable accommodated therethrough vertically from the structure to the body of water.

10. The apparatus of claim 8 in which said winder includes a drive shaft axially rotatably mounted on the vessel and carrying a pair of cable collection pulleys, which pulleys windably hold respective cables thereon.

11. The apparatus of claim 8 further including a reduction mechanism for operably interconnecting said winder and said motor for controlling the speed at which said winder rotates in said first and second directions.

12. A power driven marine ladder apparatus comprising:

a marine structure for being disposed above a body of water and for being at least temporarily occupied by one or more persons, said marine structure being a marine vessel floatable on the body of water;

a retractable ladder including a vertically extendable cable section and a horizontally extendable rung section connected transversely to said cable section;

an axially rotatable winder for mounting on said marine structure;

said cable section being attached to and wrappable about said winder;

a motor for driving said winder in a first direction to unwrap said cable section from said winder and lower said ladder toward the body of water, and in an opposite, second direction to wrap said cable section about said winder and raise said ladder from the body of water; and a guide assembly for mounting to the vessel and directing movement of said cable between said winder and the body of water in response to operation of said motor, said cable section including an elongate, flexible cable and said guide assembly including a horizontal channel for accommodating said cable section between said winder and a side of the vessel.

13. The apparatus of claim 12 in which said cable section includes a pair of generally parallel cables attached at respective upper ends to said winder.

14. The apparatus of claim 12 in which said rung section includes a single rung interconnected between said cables proximate respective lower distal ends thereof.

15. The apparatus of claim 12 in which said guide assembly further includes a directional pulley axially rotatably mounted in said channel proximate a distal end thereof for redirecting said accommodated cable vertically from the structure to the body of water.

16. The apparatus of claim 12 in which said cable section includes an elongate flexible cable and said winder includes a drive shaft axially rotatably mounted to the marine vessel and carrying a cable supporting pulley, which pulley windably holds said cable thereon.

17. A method for retrieving a person from a body of water onto a marine structure disposed above the body of water, said method comprising:

providing a retractable ladder including a vertically extendable cable section and a horizontally extendable rung section connected transversely to the cable section;

providing an axially rotatable winder on the marine structure;

providing a guide assembly for mounting to the marine structure and directing movement of said cable section between said winder and the body of water in response to operation of a motor, said cable section including an elongate flexible cable and said guide assembly including a horizontal channel for accommodating said cable section between said winder and a side of the marine structure;

attaching the cable section to and wrapping the cable section about the winder; and operating the motor to drive the winder in a first direction that unwraps the cable section from the winder and lowers the ladder toward the body of water;

allowing a person in the body of water to hold onto the lowered ladder; and operating the motor to drive the winder in an opposite, second direction with the person holding onto the ladder to wrap the cable section about the winder and raise the ladder from the body of water to the marine structure such that the person holding onto the ladder is retrieved onto the marine structure.

* * * * *